United States Patent [19]

Fleming

[11] 4,104,555

[45] Aug. 1, 1978

[54] HIGH TEMPERATURE ENCAPSULATED ELECTROLUMINESCENT LAMP

[75] Inventor: Gordon R. Fleming, Hanover, N.H.

[73] Assignee: Atkins & Merrill, Inc., Lebanon, N.H.

[21] Appl. No.: 762,853

[22] Filed: Jan. 27, 1977

[51] Int. Cl.[2] ..... H05B 33/04

[52] U.S. Cl. ..... 313/512

[58] Field of Search ..... 313/512, 506, 502

[56] References Cited

U.S. PATENT DOCUMENTS

| | | | |
|---|---|---|---|
| 3,148,299 | 8/1964 | Devol et al. | 313/512 |
| 3,346,758 | 10/1967 | Dell | 313/512 X |
| 3,430,088 | 2/1969 | Beswick | 313/512 |

*Primary Examiner*—Palmer C. Demeo

*Attorney, Agent, or Firm*—Robert F. O'Connell

[57] ABSTRACT

An electroluminescent lamp assembly wherein the basic lamp electrode structure is encased in at least one layer of a primary encapsulant material and at least one layer of a secondary encapsulant material, a layer of substantially transparent polymeric film material, which is thermally stable up to temperatures of at least 300° F., being disposed between the primary and secondary encapsulants. The polymeric film material is bonded to the primary encapsulant using a silane agent to enhance the adhesion thereto. In a preferred embodiment of the lamp assembly a gas suppressant agent is included in the electroluminescent material and the light transmitting electrode thereof has a substantially transparent and infusible coating of a polymeric material having release characteristics on its exterior surface, such coating providing an unbonded contact between such electrode and the layer of material adjacent thereto. In a further embodiment thereof the terminal leads attached to the electrodes are coated at their contact areas with a powdered solder in a curable and infusible thermosetting binder which coated areas form solder joints during the sealing of the encapsulant of the lamp assembly.

19 Claims, 3 Drawing Figures

HIGH TEMPERATURE ENCAPSULATED ELECTROLUMINESCENT LAMP

INTRODUCTION

Figure 1:
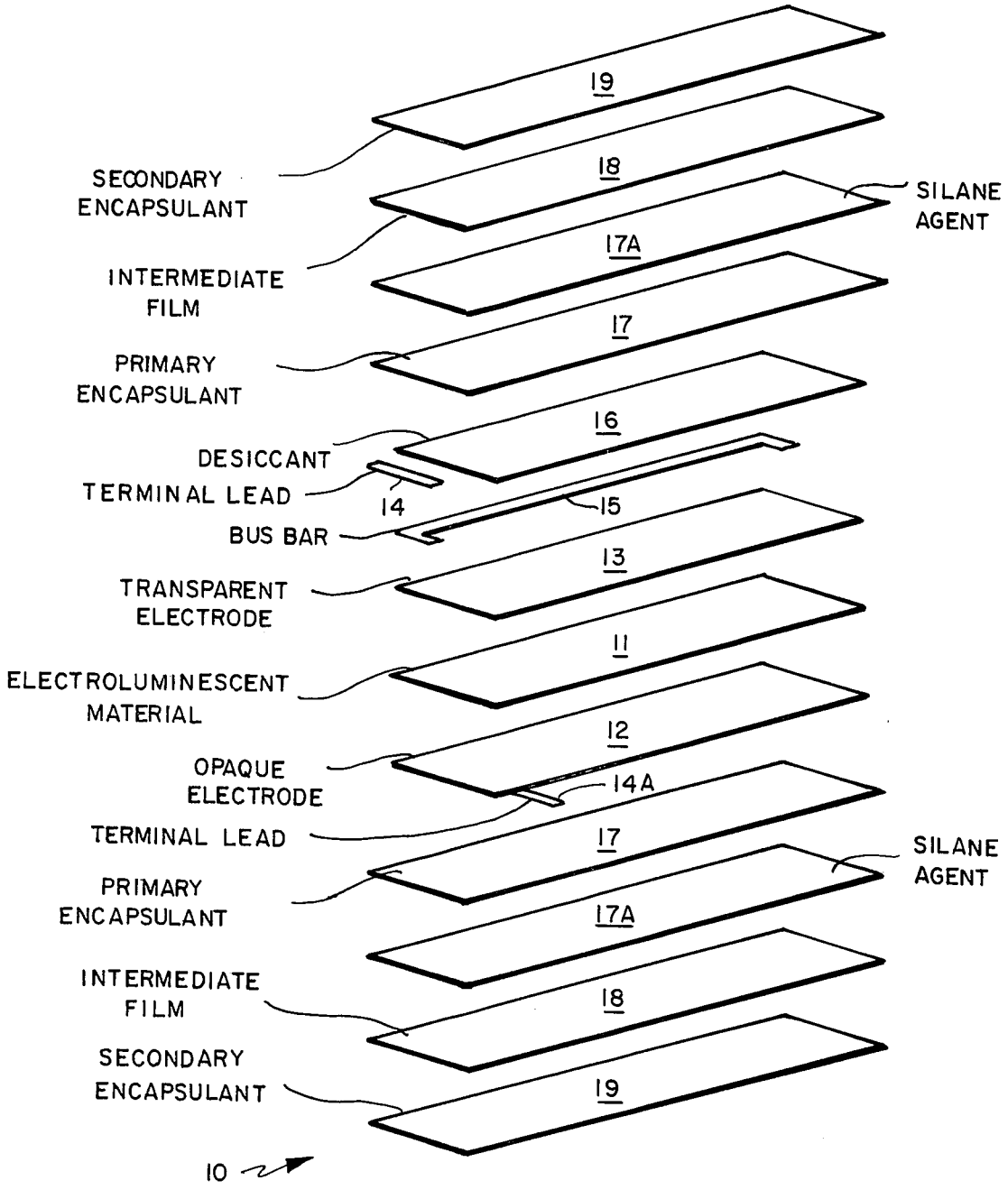

This invention relates generally to electroluminescent lamps and, more particularly, to encapsulated electroluminescent lamp structures and methods of making them so as to obtain improved structural properties capable of providing use thereof under extreme environmental and temperature conditions.

BACKGROUND OF THE INVENTION

Encapsulated electroluminescent lamps have been commercially available from many vendors for many years. Although such lamps are sometimes structurally rigid in design, more commonly they are made in flexible form. Such encapsulated electroluminescent light sources are often used for instrument panels and are particularly uniquely attractive for use as exterior lighting for aircraft or other vehicles. Thus, an electroluminescent lamp which provides an area light source on the fuselage or wings of an aircraft can be used to judge distance and orientation, in contrast with a point light source, i.e., a filament lamp, which provides relatively poor depth perception and judgment of distance. Further, although filament lamps may show excellent lifetimes under laboratory conditions, they are particularly susceptible to vibration failure, while electroluminescent lamps do not share such vulnerability. Further, filament lamps require space within the structure of an aircraft for the lamp assembly, with only the lens flush with the skin. On the other hand, electroluminescent lamps, due to their unique geometry, can replace structural panels or form an overlay bonded to the skin of an aircraft, for example. It is found that filament lamps installations have a mean time to failure which is inversely proportional to the number thereof which are used in a particular installation. Thus, as the number of filament lamps rises, the probability of a failure increases, thereby creating an owner risk maintenance problem. While filament lamps fail catastrophically (i.e. complete failure substantially at one instant of time), electroluminescent lamps, if correctly constructed, do not fail catastrophically but exhibit brightness decay characteristics independent of the lighted area being provided. The decay of modern lamps is sufficiently low to be particularly acceptable for the applications discussed above.

There has been an increasing need for electroluminescent lighting assemblies for use in high performance aircraft where the environmental and temperature requirements for the lamps are very severe. Such lamp assemblies must have the ability to repeatedly withstand exposure to temperatures as high as 360° F at an ambient pressure corresponding to an altitude of 80,000 feet. Further, they must be able to withstand continuous exposure to tropical sunlight, to salt spray, to vibration, to thermal shock, and to high humidity conditions. Combinations of such conditions tend to render inoperative and to structurally damage electroluminescent lamps and assemblies which are presently available, and it is desirable that lamp assemblies be designed to survive these conditions without damage and subsequently to meet all operational requirements at reasonable cost.

DESCRIPTION OF THE PRIOR ART

In order to form electroluminescent lamp assemblies which have some ability to withstand environmental and temperature conditions which lead to damage thereof, the basic lamp structure has normally been encapsultated in a suitable plastic material. Typically, the material employed for the encapsulation is a polychlorotrifluoroethylene (PCTFE) film, which is commercially available under such trade names as Aclar® (a trademark of Allied Chemical Co.) or Kel-F® (a trademark of 3M Company). This class of polymeric film materials includes compositions which are copolymers of CTFE and vinylidene fluoride, and terpolymers of CTFE, vinylidene fluoride and tetrafluoroethyene. A key property which has led to the use of these materials for electroluminescent lamps lies in the fact that they exhibit very low water vapor transmission rates. Such film encapsulants are easily cut with a sharp object, as would be expected for thin organic film materials. Moreover, the CTFE family of encapsulants possesses a distinct propensity to stress-induced cracking, often within a very short time. While the use of copolymers thereof with vinylidene fluoride and other materials is intended to reduce such a problem, cracking still tends to occur, although sometimes delayed over longer periods of time, e.g., after a period of weeks or even months. Large numbers of such encapsulated electroluminescent lamps have been known to fail during non-operating storage, or in their original shipping containers, because of the cracking of the PCTFE related encapsulant with subsequent moisture ingress into the electroluminescent lamp itself.

Further, when such electroluminescent lamps are subjected to temperatures in a range, for example, of 200° to 300° F (usually beginning at about 230° F), particularly with simultaneous application of a vacuum, such lamps tend to inflate, thereby producing concurrent electrode separation within the lamp. When such lamps then return to room ambient temperature, they are found to have suffered extensive internal delamination with such external manifestations as curling or wrinkling, with some or all of the light emitting surface having been rendered inoperative. Such conditions of temperature and simultaneously reduced ambient pressure as are encountered in service in military and commercial aircraft applications, particularly for exterior lighting on aircraft, makes the use of electroluminescent lamps possessing such a primary encapsulation entirely unsatisfactory and, as a consequence, such lamps are rarely, if ever, employed for such purposes.

In an effort to improve the characteristics of electroluminescent lamps, further secondary encapsulation of lamps having primary CTFE or PCTFE encapsulants have been proposed. One such structure is disclosed in U.S. Pat. No. 3,395,058, issued to E. R. Kennedy on July 30, 1968, and assigned to the same assignee as the present application. In accordance with the teachings of the Kennedy patent, flexible plastic encapsulated electroluminescent lamps are further encased in a relatively rigid armor of a glass-reinforced thermosetting plastic blanket, and thereby derive considerable protection and mechanical support. In this form, electroluminescent lamps have been fabricated in flat and curved configurations and have found wide usage in many applications, particularly for general exterior vehicular use, as on military and commercial aircraft. Nevertheless, many of the inherent deficiencies of the basic lamp structure, including the propensity for PCTFE stress cracking and the problems which arise at elevated temperatures and reduced pressures, are not overcome by the Kennedy structure and method of manufacture.

Other secondary encapsulation techniques which have been proposed by the prior art have included lamination of the primary encapsulated lamp between sheets of a rigid plastic material, the potting of the primary encapsulated lamp in thermosetting resins, or the placement of the primary encapsulated lamp within an injection mold and the subsequent injection of molten resin around the lamp. Such techniques result in structures wherein the interface between the outer secondary encapsulant and the primary CTFE or PCTFE encapsulant is either not bonded or is typically partially bonded in patches across the surface. Differential thermal expansion at the interface thereupon leads to progressive delamination. Since such delamination relieves the stress, it typically proceeds in a partial and non-uniform manner.

The forming of a uniform and lasting bond is particularly difficult with fluorohalocarbon-encapsulated lamps, since such materials are not readily bonded to dissimilar materials. In common with other fluorocarbons, the low energy surface thereof is not wetted or bonded by commonly used encapsulants, such as epoxy, urethane or polyester resins. While it is true that certain permanently tacky materials, such as various kinds of pressure-sensitive tapes, will adhere to materials like Aclar, such bonds will not resist temperature cycling and, furthermore, tend to age, with the resultant failure of the joint. While fluorinated polymers in some applications can be bonded after etching thereof with powerful agents, such as sodium naphthlene dispersion, such a treatment involves substantial discoloration which is entirely unacceptable, particularly in many of the desired applications discussed above.

A partially wetted or bonded condition over the light emitting surface of a duo-encapsulated electroluminescent lamp effects the manner in which light is transmitted across the interface thereof. An area where the CTFE or PCTFE is wetted by the secondary encapsulant displays a light distribution as a function of viewing angle, which is known as a "lambertian" distribution which obeys a "cosine law" (light distribution is a function of the cosine of the viewing angle). A non-wetted area, possessing as a consequence a layer of gas (e.g. air) between encapsulant surfaces, has distinctly directional properties being brightest when viewed from a direction orthogonal to the light emitting surface while appearing relatively dim when viewed at a steep angle. This behavior is predicted by Snell's law and is a consequence of the difference in refractive indices between air and polymeric materials.

Further, the lack of a bond between the inner and outer encapsulants results in the provision of a sole anchor point between the flexible lamp with its close fitting cavity and the conforming outer structure at the lead-in wires or ribbons. Differential thermal expansion, along with shock and vibration, can result in fracture of these electrical leads at their points of exit from the CTFE or PCTFE package.

The physical restraint imposed by a rigid reinforced plastic encapsulating structure as suggested by the prior art does not prevent the physical failure of the flexible plastic lamp in the aforementioned 200° to 300° F temperature range, particularly at reduced atmospheric pressure. Further, it does not prevent a gradual time and temperature dependent crazing, checking and stress-cracking of the CTFE or PCTFE inner encapsulant. The latter problem is particularly severe whenever the structure geometry dictates that the lamps conform to a tight radius bend. It has also been found that various resin constituents employed in thermosetting reinforced plastics formulations promote and nucleate stress-induced cracking and, accordingly, limit the choices of encapsulating resins which can be used. Therefore, instead of selecting resins for the optimum structural, thermal and mechanical properties, along with their maximum environmental resistance, the most effective selections thereof consistent with the avoidance of nucleation or crazing in the primary encapsulant must be used. Such resins unfortunately have proven to be lacking in the desired physical properties which are required in many applications.

BRIEF SUMMARY OF THE INVENTION

In accordance with the invention, an electroluminescent lamp assembly includes an intermediate film of polymeric material placed between a primary encapsulant and a secondary encapsulant. The polymeric film is bonded to the primary encapsulant by a suitable bonding agent, preferably a transparent silane agent, which effectively promotes the bonding of the polymeric film. The latter film provides a thin transparent and substantially colorless skin which permits the selection of a wide variety of secondary encapsulants possessing excellent thermal structure and environmental characteristics when correctly molded and cured. Electroluminescent lamp structures, when so modified in accordance with the invention, exhibit neither immediate nor long-term stress cracking as is often found in previously available structures, which cracking often causes local moisture to ingress into the phosphor layer so as to cause blackening or other discoloration thereof. Such an intermediate film is also readily and uniformly wetted by the secondary encapsulant so as to avoid the unsightly and blotchy appearance and non-uniform light emission of previous lamps due to the poor wetting which occurs when placing the secondary encapsulant in direct contact with the primary encapsulant. The strong inter-layer bonding which occurs also produces a higher bending (stiffness) modulus for the invented structure as compared to that obtained by previous techniques.

Further improvement can be achieved in accordance with the invention by providing an interface at the plane between the front, or transparent, electrode of the electroluminescent lamp and the overlying desiccant and water vapor barrier layers, which interface is such that no permanent bond exists anywhere therebetween. Such a complete and uniform separation at such interface, in the presence of a thermal vacuum, assures that the lamp is not rendered inoperable during use. In contrast, in lamps of the prior art, attempts were made to permanently bond such interface. During use such bond tended to separate only partially at various separate regions thereof, due to thermal vacuum, which condition caused inoperability of the lamp structure.

Moreover, it has been found that the addition of a suitable chemical agent to the dielectric material of the basic lamp structure to suppress the generation of internal gaseous material prevents inflation of the lamp package at high temperatures and low pressures and thus avoids the internal delamination which often occurs when gas is generated within the sealed package.

Moreover, in accordance with the invention, further improvement can be achieved by correctly positioning the electrical terminal leads of the lamp structure within the primary encapsulant, and painting the areas of contact therebetween with a powdered solder in a thermosetting resin vehicle without any further means for positively securing them in place. The terminals are then thermally sealed under pressure within the primary encapsulant, and during operation the electrical contact is not disengaged even in the presence of relatively extreme thermal cycling.

DESCRIPTION OF THE INVENTION

Figure 3:
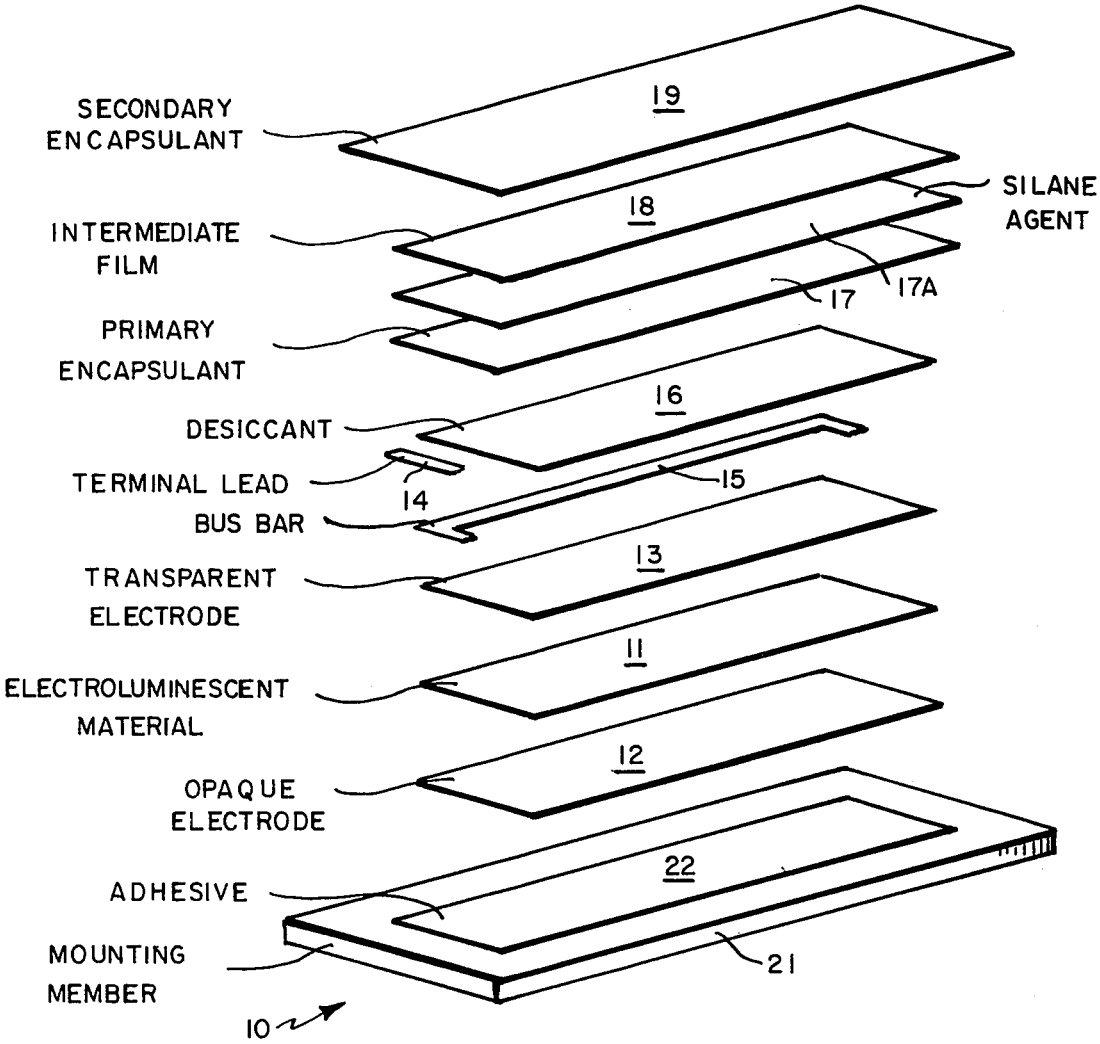
Figure 2:
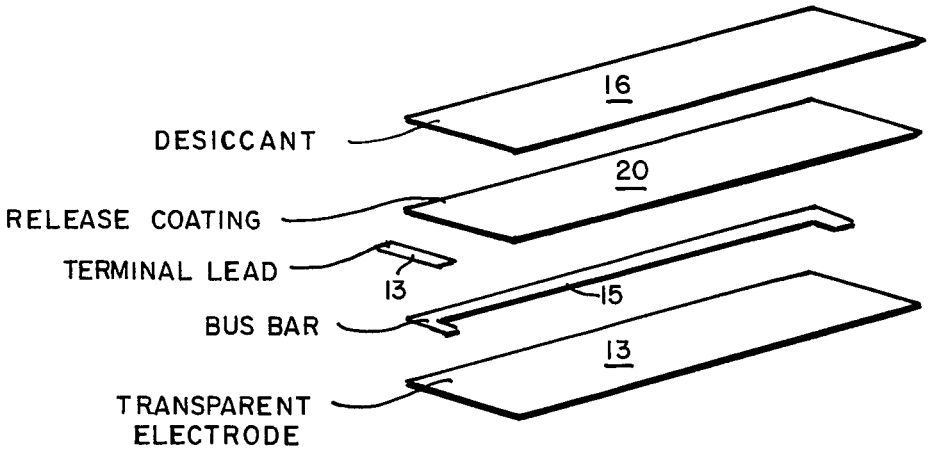

The invention can be described in more detail with the help of the accompanying drawings wherein FIG. 1 shows an exploded view of one embodiment of a lamp structure of the invention;

FIG. 2 shows an exploded view of a portion of an alternative embodiment of the invention; and FIG. 3 shows an exploded view of still another alternative embodiment of the invention.

An electroluminescent lamp assembly 10 in accordance with the invention is shown as FIG. 1, wherein the basic lamp structure comprises a layer 11 of an electroluminescent material such as a suitable phosphor compound in the form of a powder dispersed in a binder of dielectric material, bonded on one side to a metallic layer 12 such as aluminum foil, which forms a rear, opaque electrode. A front transparent, or translucent, electrode 13 is placed over the other side of the electroluminescent layer and forms an electrode such that when an alternating electric field is established between the front and the rear electrodes, the electroluminescent material luminesces, as is well known to those in the art. The electric field can be established by applying an alternating voltage to terminal leads 14 and 14A appropriately connected to the electrodes either directly or via a bus bar and accessible externally to the lamp as shown. Thus, lead 14 may be connected to a bus bar 15 which is in turn attached to the electrode 13, while the terminal lead 14A may be attached directly to the foil electrode 12.

A layer 16 of desiccant material may be formed over the front electrode 13 to absorb moisture which may be present during manufacture or operation. The basic lamp structure is then encased in layer 17 of a primary encapsulant, which normally encloses the entire structure over both electrodes as shown. The primary encapsulant being used successfully by those in the art is typically a polychlorotrifluoroethylene (PCTFE) film, one such film being commonly sold under the trade designation "Kel-F" and available from The 3M Company, Minneapolis, Minnesota. Other primary encapsulants which have been used include copolymers of CTFE and vinylidene fluoride, available under the trade designation "ACLAR-22" and terpolymers of CTFE, vinylidene fluoride and tetrafluoroethylene, available under the trade designation "ACLAR-33", both sold by Allied Chemical Company, Morristown, New Jersey.

In practice, such basic lamp structures are available in assembled form with the primary encapsulant already formed thereon, or, alternatively, the process of the invention can be initiated using a basic lamp electroluminescent/electrode structure without a primary encapsulant and a suitable desiccant and primary encapsulant later being formed, as required.

It is desired that the primary encapsulated structure be further encased in a secondary encapsulant in order to protect the lamp structure from moisture and other deleterious substances in whatever environment they may be placed for storage or operation. The use of a secondary encapsulant must be such that the overall lamp is not subjected to stress-induced cracking of the primary encapsulant when used under severe environmental conditions, as discussed above.

Such problems are substantially effectively eliminated by the use of the structure shown in FIG. 1 wherein, prior to encasing the primary encapsulated lamp in a secondary encapsulant, it is first placed between two layers 18 of polymeric film material which is bonded to the exterior surface of the PCTFE primary encapsulant to form a thin transparent skin having a preferably clear, or at least a moderately yellow, appearance. Such thin layer 18 may be formed from various film or sheet materials, such as nylons, polycarbonates, celluloses, polyolefins, polyethylene teraphthalate, and the like. Such films must be selected to be thermally stable up to temperatures as high as about 300° to about 425° F. at pressures up to 200 to 300 psi, and preferably at least up to a range of about 80 to about 130 psi. In addition, such films must have good bonding characteristics for bonding to the secondary encapsulant material. Accordingly, totally fluorinated materials, such as tetrafluoroethylene and other like materials, although having appropriate thermal stability, should be avoided since they are not capable of effectively bonding to the secondary encapsulant.

In order to assure that a good bond exists between the polymeric film layer and the primary encapsulant layer, the exterior surface of the primary encapsulant is preferably treated with a material which will enhance the adhesion between such organic polymer layers. Materials which have unexpectedly proven useful for such purpose include silane coupling agents which are applied, together with a solvent, to the surface of the primary encapsulant so as to provide a transparent and minimal deposit thereof on such surface, illustrated diagrammatically, for simplicity, by layers 17A in FIG. 1. While such silane coupling agents have been utilized to promote bonding when using inorganic materials, such as glass, for example, it would not normally be expected that they would promote adhesion between two layers of organic materials. However, it has been found that adhesion is considerably enhanced when using such silane agents to bond the polymeric film layer and the primary encapsulant layer in accordance with the invention.

Silane agents, which had been found to be suitable for such purpose, include relatively simple silane compounds such as vinyltrichlorosilane and combinations of a silane with a resin, such as an epoxy resin. One successful method of applying such silane agent is to submerge the primary encapsulated lamp in a solution comprising the silane agent taken together with a solvent, such as methylethyl ketone mixed with N-propyl alcohol (an additional wetting agent, such as a high molecular weight agent sold under the trade designations BYK-P-104M by Byk-Gulden, Inc., Hicksville, L.I., New York, may be used, although such wetting agent may not be necessary). Silane agents which are commercially available at present and which have been found to be effective are sold under the designations, for example, A-1100® by Union Carbide Corporation, Z-6042 ® by Dow Corning Corporation, and KH-1 ® by Allied Chemical Corporation.

The primary encapsulated lamp thus treated is thereupon placed between the two polymeric films and subjected to temperatures in the range of 300° to 425° F. at pressures preferably in a range of 80 to 130 psi. A preferred polymeric film material that has been successfully used is poly(methyl methacrylate) film, one such acrylic film being sold under the designation "Korad" ® by Korad, Inc., Newark, New Jersey. Such film is adequate for the application herein described if used in the finished commercially available gauges, for convenience, film having thicknesses of 0.001 to 0.003 inches being generally suitable.

The silane agent bonds the dissimilar CTFE and copolymer film materials by forming a suitable coupling agent or molecular bridge. However, the use of this technique with a thin polymeric skin to prevent stress cracking in CTFE encapsulated electroluminescent lamps was not previously known. Obtaining a satisfactory bond is in no way dependent on the particular film thickness other than the difficulty which normally arises in handling such thin sheet materials and in performing the requisite operations. Thus, the electroluminescent lamp in its primary encapsulant acquires a very thin adherent, substantially colorless and transparent, skin of acrylic film. While not absolutely necessary, the bonding action is most desirably performed by placing the polymeric film encased structure between the surfaces of a fine mesh cloth with release properties, which cloth serves as a gas bleeder to ensure that no entrapped gas bubbles are retained between the primary encapsulated lamp and the thin acrylic skin. Such a bleeder material may be a porous material such as sold under the designation "3TA" ®, a Teflon ® coated glass fabric cloth manufactured by Dodge Fluorglass Div. of Oak Industries, Inc., Hoosick Falls, N.Y. The mesh further impresses a rough texture upon the acrylic surface which serves to enhance the succeeding processing steps.

While the acrylic film may be applied to a primary encapsulated lamp structure, as discussed above, a similar result is obtainable by laminating the acrylic film and PCTFE primary encapsulant in advance of performing the primary lamp encapsulation. Thus, a film PCTFE primary encapsulant may be wetted with a silane solution, as by a conventional coating method such as reverse roll coating designed to wet only one side of the PCTFE film. The wetted film is dried in line and the acrylic film and the dried PCTFE film are then placed together and passed immediately through the nips of heated laminating rollers to produce a compound film. Typical film thicknesses would include 0.0075 inch of PCTFE along with a 0.0015 inch of acrylic film. The resultant compound film material serves as raw stock for the primary encapsulation of the basic electroluminescent lamp structure, constructed with the acrylic film surface facing out. A similar procedure may be employed to coat the next innermost desiccant film layer of the lamp, which may be nylon 6 or the like. As a result, when the lamp is sealed with a compound film, the PCTFE in no case possesses an unbonded film interface. In the case of the film covering the rear or foil surface 11 of the lamp, a reasonably good bond is usually obtained directly to the aluminum foil without the necessity for a special coating and preparation.

Once the primary encapsulated lamp has been encased in the copolymer film, as discussed above, a large variety of resins or other materials can be selected for a secondary encapsulation. For example, one such material that has been successfully used, and seems generally preferable because of its excellent physical properties, is a 181 type glass fabric saturated with epoxy resin, sold under the designation E293FC ® by Ferro Corporation, Norwalk, Connecticut, which material is found to possess excellent thermal, structural and environmental characteristics when correctly molded and cured. Such molding and curing procedures are well known in the art and variously called "pressure bag molding" or "autoclave molding" or "RP press molding", as described, for example, in the aforementioned Kennedy patent.

Primary encapsulated electroluminescent lamps of the art, when further encapsulated using, for example, the above E293FC without the use of the intermediary copolymer film between the primary and secondary encapsulants, are invariably observed to exhibit severe stress cracking, usually within a week but often even after some months have elapsed. When such light assemblies are energized after a period of storage, for example, local moisture ingress in the vicinity of the cracks causes the adjacent phosphor layer to turn grey or black. This has the effect of causing the network of cracks to be outlined in sharp relief over the light emitting surface. By contrast, electroluminescent lamps modified according to the teachings of the present invention exhibit no immediate or delayed stress cracking due to encapsulation of such a resin system. Modified lamps possessing such an intermediate acrylic skin, particularly when possessing a roughened surface due to the bleeder cloth employed during the out-gassing process, are readily wetted by encapsulating resins and preferred systems, such as epoxy prepreg E293FC, are able to attain tenacious adhesion. In contrast, previously available lamps with the characteristic PCTFE primary encapsulant are usually poorly wetted, creating an unsightly, blotchy appearance. Light emission is thereby rendered non-uniform, and adhesion of the secondary encapsulant is often non-existent. Because of the strong inter-layer bonding between the primary and secondary encapsulants in the invention, the bending modulus (i.e., the stiffness) of the new structure is appreciably harder than that obtained by earlier used structures.

Another factor leading to damage or destruction of such electroluminescent lamp assemblies during subsequent exposure to severe test or service conditions arises due to the generation of gas within the sealed lamp structure. A major source of gas generation is the tendency of polymers, particularly cyanoethated polysaccharides, which are widely used as the dielectric embedding medium for electroluminescent phosphorus, to exhibit some degree of thermal decomposition during use with resultant generation of polymeric or monomeric fragments or substances, such as water or $CO_2$, of vapor pressure sufficient to inflate the sealed envelope. In order to avoid such a problem and further improve lamp operation in accordance with the invention, certain chemical agents are added to dielectric materials to suppress this tendency towards gas generation. Two catagories of chemical agents effective in reducing or substantially eliminating the generation of internal gaseous materials are cross linking agents and antioxidants. The effectiveness of these materials can be demonstrated by noting the lack of inflation of the sealed package under temperature and pressure conditions of about 365° F. with a vacuum simulating an ambient pressure equivalent to that present at about 80,000 feet of altitude. These two classes of chemical additives may be employed separately or in combination.

It is known that certain bifunctional or multifunctional "cross linking agents" render cyanoethylated polysaccharide ethers relatively insoluble and infusible. Certain of these agents have been found particularly effective in reducing gas generation, probably due to enhanced thermal stability of the polymer. One preferred agent useful for such purposes is commercially available under the designation Isonate 123P® sold by the Upjohn Chemical Company, Kalamazoo, Michigan, being a "blocked urethane" agent. Inclusion of this agent as an additive within the cyanoethylated dielectric eliminates for all practical purposes the problem of inflation and the resultant internal delamination under conditions of thermal vacuum. This agent is effective in concentrations of from about 0.1 to about 5.0% by weight of the cyanoethylated resin. Since the higher concentrations sometimes tend to adversely affect lamp brightness, a preferred concentration of about 0.5% is recommended.

A second class of chemical additives effective in the present instance fall within the classification known as "antioxidants". They act by opposing oxidation and inhibiting reactions promoted by oxygen or peroxides. When added in small proportions, they enhance thermal stability and retard aging. In particular, phenylene diamine derivatives and similar primary antioxidants have been found effective in the present instance. A preferred agent, an amine antioxidant, is Naugard 445, manufactured by Uniroyal Inc., Naugatuck, Connecticut, which is effective in concentrations of 0.05 to 0.5%.

A further improvement for assuring that an electroluminescent lamp does not become inoperable due to thermal vacuum derives from the concept that an internal lamp delamination may be permissible provided that it takes place along a plane and at a preselected interface such that the delamination does not render the lamp inoperable, but instead involves a separation of the basic light emitting capacitor structure from those layers which comprise the lens, or front, portion of the primary encapsulant envelope. Such interface exists, for example, between the front, or transparent, electrode and the overlying desiccant and water vapor barrier-layers of the primary encapsulant. The compositions and methods of producing flexible, transparent electrodes are well known in the art and normally comprise pigments, coated fibers, or films, of transparent semiconducting materials such as $SnO_2$ or $In_2O_3$. Thus, one practice widely employed in the prior art uses fibrous materials coated with transparent, conductive films to serve as an electroluminescent lamp front electrode, as shown, for example, in U.S. Pat. No. 2,849,339, issued to Jafee on Aug. 26, 1958, and U.S. Pat. No. 3,346,758, issued to Dell on Oct. 10, 1967, incorporated herein by reference. For the purposes of the present invention discussed herein, the selection of such front electrode compositions is not limited except insofar as said compositions are chosen with melting or softening points sufficiently higher than temperatures encountered in any subsequent theremal processing, so that no bond to the overlying package will form. Moreover, no pressure sensitive adhesives, tackifiers or adhesion-promoting plasticizers should be present which might result in a bond along the aforementioned interface, or which might release the volatiles under conditions of thermal vacuum. Accordingly, as shown in FIG. 2, the transparent front electrode 12 may be covered with an infusible, flexible, transparent polymeric layer coating 20 which possesses release properties in the manner of mold release agents and like compositions between electrode 13 and the desiccant layer 16. Thus, a composition comprising about 20 about 80% by volume of polyvinyl butyral, together with a portion of methylol butylated melamine resin to total 100% by volume may be used. Thus, compositions commercially available under the designations Butvar® B74 and Resimene® 881, respectively, both sold by the Monsanto Chemical Company, can be used to form a release agent which becomes infusible upon subsequent baking, a favorable temperature range therefor being about 400° to about 410° F. After proper baking, the film is transparent, flexible, and essentially infusible.

Such a film is sufficiently thin, adherent and permeable to volatiles that vacuum baking of the unpackaged lamp assembly consisting of metal foil, dielectric and phosphor containing layers, transparent electrode and overcoat, does not result in any delamination, blistering, loss of structural integrity, or impairment of operation in the temperature range up to 410° F. of many hours duration. The making of film overlay, which will be adjacent thereto, and which comprises the interface of the primary encapsulant envelope, is also selected for its infusibility and release properties. Specifically, when the lamp is primarily encapsulated by heat sealing, no bond forms at this interface, although the surfaces are in intimate contact. Moreover, if both surfaces are rough or matte in texture, the light distribution of the resultant lamp does not produce directional, or non-lambertian, characteristics due to crossing the interface. Reduction of the luminous intensity due to losses at the interface is minimal. Several polymeric film materials, such as polyethylene teraphthalate, for example, commercially available under the designation Mylar®, sold by E. I. duPont Company, or poly(ethylene-chlorotrifluoroethylene), commercially available under the designation Halar®, sold by Allied Chemical Company, nylon 6, nylon 6/6 or nylon 101, readily commercially available from many sources, all have sufficiently high melting or softening temperatures to avoid formation of a bond at the interface, while nonetheless achieving sufficient flow to obtain closely conforming matte surfaces with a slight degree of essentially mechanical adhesion.

Upon exposing the resultant package to thermal vacuum sufficient to promote gas formation within the package and thereby cause the package to inflate, it is found upon return to room ambient conditions that the lamp function is unimpaired, even though the structure has delaminated along the predesignated release interface.

Still another modification of the primary lamp structure can be used, such modification being related to the present practice of effecting electrical terminations within the PCTFE primary package solely by pressure contact, which is now achieved by thermally sealing the lamp with the leads properly positioned but otherwise not positively secured. The primary encapsulant seals around and over the leads, which may take the form of solid or perforated copper ribbons or, alternatively, copper or other metal mesh. While adequate for many applications, it is clear that if the package inflates due to internal gas generation, electrical contact may be lost. It has been found that, in accordance with a further modification of the invention, if the contact area is coated with a paint consisting of powdered solder in a thermosetting polymeric vehicle, positive electrical contact in the form of a solder joint is obtained during the lamp sealing cycle. Additional thermal cycling does not disengage the bond because of the presence of the thermosetting binder, which becomes relatively cured and infusible during sealing of the lamp. Any of a number of readily available expoxy compounds or polymers which are rendered infusible due to condensation polymerization with suitable curing agents may serve as the binder matrix. A preferred solder powder is a 50% indium, 50% tin alloy, sold commercially by the Indium Corporation of America, Utica, New York, under the designation "Indalloy No. 1".

It may be seen from the foregoing description that the spirit and intent of the present invention does not depend upon the exact sequence in which the structure is assembled, with the reference to the application of the acrylic film to either standard commercially procured lamps or to completed lamps of inhouse manufacture which are already primary encapsulated, or to the PCTFE primary encapsulant envelope materials in advance of lamp manufacture and assembly. The method of cladding the PCTFE primary encapsulant with the acrylic film is similar whether the cladding film is obtained as a commercial item or is coated or extruded onto the PCTFE. The method works in a comparable fashion if the silane agent is deposited upon the cladding film rather than upon the PCTFE prior to thermal lamination. The method is widely applicable and is effective toward greater or lesser degree for polymeric cladding materials other than acrylic.

Similarly, the sequence of assembly of the secondary encapsulant is not critical. The intent of the method is to apply a rigid armor of glass fiber or fabric reinforced thermosetting plastic, intimately bonded to the primary encapsulant through the medium of an intermediary polymeric skin. Thus, in some applications it is adequate to apply the secondary encapsulant to only one side of the primary encapsulated lamp rather than completely surrounding the entire lamp assembly. For example, as shown in FIG. 3, the rear electrode 12 of the lamp assembly might be bonded directly to a rigid mounting block, or plate 21, or to a structural panel member as used in an aircraft or other vehicle, or to any other suitable assembly means and would remain free of primary and secondary encapsulants. In such case, the interface between the light assembly and the mounting surface can be filled with a suitable adhesive or sealant 22, as shown. If the light assembly assumes a complex shape, further support in the form of ribs or an internal filler, such as syntactic foam can be used for reinforcement. The step of bonding the reinforced plastic layers to the primary lamp assembly could equivalently be accomplished by employing a thermosetting resin to bond a precured reinforced plastic sheet. The light assembly may also receive protective or decorative coatings over the reinforced plastic surface as an aid to appearance, maintenance, or for other specific functions.

Hence, the invention is not to be construed as limited solely to what is specifically disclosed above, except insofar as defined by the appended claims.

What is claimed is:

1. An electroluminescent lamp comprising a layer of electroluminescent material disposed between a pair of electrodes, at least one of said electrodes being capable of transmitting light emitted by the electroluminescent material therethrough;

at least one layer of a primary encapsulant material encasing at least one of said pair of electrodes;

at least one layer of substantially transparent polymeric film material encasing said at least one layer of primary encapsulant material; and at least one layer of a secondary encapsulant material encasing said at least one layer of polymeric film material.

2. An electroluminescent lamp in accordance with claim 1 wherein said polymeric film material is bonded to the exterior surface of said at least one layer of primary encapsulant material and further including a substantially transparent adhesion promoting agent applied to said at least one layer of primary encapsulant material.

3. An electroluminescent lamp in accordance with claim 2 wherein said adhesion promoting agent comprises at least a silane compound.

4. An electroluminescent lamp in accordance with claim 3 wherein said adhesion promoting agent further includes a thermosetting resin material.

5. An electroluminescent lamp in accordance with claim 4 wherein said silane compound is vinyltrichlorosilane.

6. An electroluminescent lamp in accordance with claim 5 wherein said thermosetting resin is an epoxy resin material.

7. An electroluminescent material in accordance with claim 1 wherein said polymeric film material is selected to be thermally stable up to temperatures of at least 300° F. at pressures up to a range from about 200 to about 300 psi.

8. An electroluminescent material in accordance with claim 7 wherein the thickness of said at least one layer of polymeric film material is between about 0.001 to about 0.003 inches.

9. An electroluminescent lamp in accordance with claim 8 wherein said polymeric film material is taken from the class of materials consisting of nylons, polycarbonates, celluloses, polyolefins, and polyethylene terephthalates.

10. An electroluminescent lamp in accordance with claim 1 wherein said layer of electroluminescent material further includes a gas suppressant agent for substantially eliminating the generation of internal gaseous materials during fabrication or operation of said electroluminescent lamp.

11. An electroluminescent material in accordance with claim 10 wherein said electroluminescent material includes a dielectric medium and said gas suppressant agent is added to said electroluminescent material in concentrations within a range from about 0.1 to about 5.0% by weight of said dielectric medium.

12. An electroluminescent lamp in accordance with claim 11 wherein said concentration is about 0.5%.

13. An electroluminescent material in accordance with claim 10 wherein said gas suppressant agent is a blocked urethane agent.

14. An electroluminescent lamp in accordance with claim 1 and further including a substantially transparent and infusible coating of a polymeric material on the exterior surface of said at least one light transmitting electrode, said coating having release characteristics for providing an unbonded interface contact between said at least one light transmitting electrode and the layer of material adjacent thereto.

15. An electroluminescent lamp in accordance with claim 14 wherein said coating comprises about 20 to about 80% by volume of polyvinyl butyral and about 80 to about 20% of methoxy butylated melamine resin.

16. An electroluminescent lamp in accordance with claim 14 wherein said coating comprises a film material selected from the class consisting of polyethylene teraphthalate, poly(ethylenechlorotrifluoroethylene), nylon 6, nylon 6/6 and nylon 101.

17. An electroluminescent lamp in accordance with claim 1 and further including terminal means connected to each of said pair of electrodes;

a coating of powdered solder in a curable and infusible thermosetting binder applied to the contact areas between said terminal means and said electrodes, said coating forming solder joints during the sealing of said encapsulant layers of said lamp.

18. An electroluminescent lamp in accordance with claim 17 wherein said powdered solder comprises about 50% by weight of indium powder and about 50% by weight of tin alloy powder.

19. An electroluminescent lamp in accordance with claim 18 wherein said thermosetting binder is an epoxy resin.

* * * * *